US006109236A

United States Patent [19]

Takahashi et al.

[11] Patent Number: 6,109,236

[45] Date of Patent: Aug. 29, 2000

[54] ENGINE IDLE SPEED CONTROLLER

[75] Inventors: Nobutaka Takahashi, Yokohama; Yoshitaka Deguchi, Kanagawa, both of Japan

[73] Assignee: Nissan Motor Co., Ltd., Yokohama, Japan

[21] Appl. No.: 09/084,115

[22] Filed: May 26, 1998

[30] Foreign Application Priority Data

May 26, 1997 [JP] Japan ..... 9-134585
May 26, 1997 [JP] Japan ..... 9-134586

[51] Int. Cl.[7] ..... F02M 3/00

[52] U.S. Cl. ..... 123/339.19; 123/339.23

[58] Field of Search ..... 123/339.19, 339.23

[56] References Cited

U.S. PATENT DOCUMENTS

| | | | |
|---|---|---|---|
| 4,742,462 | 5/1988 | Fujimori et al. | 123/339.19 |
| 4,836,176 | 6/1989 | Fujino et al. | 123/640 |
| 5,375,574 | 12/1994 | Tomisawa et al. | 123/339 |
| 5,415,143 | 5/1995 | Togai | 123/339.19 |
| 5,492,095 | 2/1996 | Hara et al. | 123/339.19 |
| 5,567,387 | 10/1996 | Igarashi et al. | 123/339.23 |
| 5,839,410 | 11/1998 | Suzuki et al. | 123/339.23 |
| 5,947,084 | 9/1999 | Russell et al. | 123/339.23 |

FOREIGN PATENT DOCUMENTS

| | | |
|---|---|---|
| 63-159614 | 7/1988 | Japan . |
| 1-313636 | 12/1989 | Japan . |

OTHER PUBLICATIONS

Patent Abstract of Japan, 01313636, Dec. 19, 1989, Takahashi Hiroshi, "Controller for Internal Combustion Engine for Vehicle".

*Primary Examiner*—John Kwon
*Attorney, Agent, or Firm*—Foley & Lardner

[57] ABSTRACT

The invention prevents engine speed from being decreased (or engine stall) by a disturbance (such as turning on the air conditioner) during idling. During idle control, a target idle speed is used as an engine speed parameter in place of the actual engine speed to calculate intake air, so that the engine speed is not decreased by a disturbance for very long. Also, target generation torque can be set so as to maintain target idle speed.

12 Claims, 19 Drawing Sheets

ENGINE IDLE SPEED CONTROLLER

BACKGROUND OF THE INVENTION

The present invention is directed to an engine idle speed controller.

First, engine control during normal (that is, non-idling operations) will be described.

An engine control apparatus (hereinafter referred to as an engine torque demand system (ETD system)) has been devised to calculate a required target torque, in accordance with the driver's accelerator operation, external loads, and the like, and to perform control so as to cause the engine to generate the target torque.

Japanese Patent Publication 1-313636, for example, discloses an engine torque demand system designed to calculate an engine target torque in accordance with an, accelerator operation quantity, engine speed and an external load, and to control a fuel injection quantity and a supply air quantity in accordance with the target torque.

Such a torque demand type of engine control apparatus calculates a target generation torque by adding, to the required output torque (determined based on accelerator depression), a loss load torque such as friction torque appearing as a loss in the engine and power train system, and controls the fuel injection quantity and the supply air quantity so as to achieve the target generation torque This torque demand system produces improvements in driveability by using, as a reference value for control, he torque of the engine, which is a physical quantity directly acting on the control of the vehicle.

A control system for a direct injection gasoline engine (arranged to inject fuel directly into the combustion chamber) is shown in Japanese Patent Publication No. 63-159614. This system is designed to produce extremely lean combustion at an air-fuel ratio of about 40 to 50 at a low speed, low load operating region in order to improve fuel consumption; and to enrich the air-fuel ratio continuously or in a stepwise manner as the load or speed increases. The set air-fuel ratio is not necessarily determined as a constant in accordance with an operating condition. For example, the air-fuel ratio can conceivably be set near the theoretical air-fuel ratio at the time of a cold engine operation, at which lean combustion of a stratified gas mixture is difficult.

In the case of an engine in which the air-fuel ratio is varied widely in this way, a direct relation between the generation torque and the quantity of the intake air is lost. In the case of control of the generation torque, it is necessary to control the intake air quantity in accordance with the set air-fuel ratio.

Namely, an appropriate method to control the generation torque of such an engine to control the vehicle motion, or the revolution speed at idle, is to first set a target value as an intermediate variable, such as a target generation torque, and then determine a manipulated variable(s) (intake air quantity and fuel injection quantity) to achieve the target, instead of directly controlling the air quantity, which has no direct relationship with the generation torque. Much attention has been given to an engine control apparatus employing engine torque demand control.

On the other hand, an engine control system can be arranged to selectively use utterly different control methods for idling operation and for non-idle operation. For example, engine torque demand control can be used for non-idle operation and some other control method can be used for idle operation. However, changeover between the control methods poses a difficult problem as to how to provide a smooth transition between the idle state and the non-idle state.

When a vehicle is in an idle running state and the generation torque in the idle state is relatively great, and for example the driver depresses the accelerator slightly, the control technique might be changed from idle control to non-idle control and a predetermined generation torque may be produced at that state. However, such a predetermined generation torque can be smaller than the generation torque dictated by the idle control technique due to the differences in the control techniques. In such a case, despite the slight depression of the accelerator, the vehicle speed decreases, contrary to the driver's intention, causing a very unnatural bodily feeling.

The inventors have recognized that it is desirable to configure an engine control system to employ the same basic control technique of torque demand control regardless of whether the vehicle is in the idle condition or the non-idle condition, to thereby improve driveability. However, as the inventors have also recognized, there are problems with employing torque demand control for both idling operations and non-idling operations.

In the above-mentioned Japanese Patent Publication No. 1-313636, the throttle opening degree ($\theta_o$) to control the supply air quantity is set to a characteristic such as shown in FIG. 1 (which shows target torque To versus engine speed Ne). In FIG. 1, the characteristic is such that, if the target torque (To) is constant, the throttle opening degree is increased as the engine speed (Ne) increases. This means that in the state of the same throttle opening degree, the torque decreases as the engine speed increases. This is the same as the characteristics of an ordinary engine.

As an example of loss load torque, to be added to the required output torque, it is possible to identify internal losses of the engine such as engine friction and pumping loss. Characteristics, as shown by way of example in FIG. 2, indicate that the load torque decreases with a decrease in the engine speed in the region of normal engine speeds. FIG. 2 shows the friction loss due to piston(s) and cam(s), and the load of pumps such as the water pump and oil pump, together. Other loads also have approximately-similar tendencies. As a whole, the load torque generally decreases with a decrease in the engine speed.

Therefore, the control system in a torque demand system is fundamentally arranged to have characteristics like those in FIG. 1.

During driving, in response to the required torque, the engine torque demand system opens the throttle in accordance with the engine speed and increases the supply air quantity as the engine speed increases.

If the air-fuel ratio of the gas mixture formed in the combustion chamber is constant (for example, at the theoretical air-fuel ratio), the generation torque is approximately proportional to the mass of air sucked into the cylinder (the air mass per cylinder). Therefore, it is necessary to supply the intake air quantity (the quantity of flow per unit time) in proportion to the engine speed to produce the same torque irrespective of variation of the engine speed. Accordingly, air quantity manipulation of opening the throttle with an increase in the engine speed is proper.

However, in addition to the normal driving state, there is the idling state during which the engine speed is maintained at a low level to prevent the engine from stopping. In the idling state, there is the following problem when torque demand control for normal operation is applied to idling.

During an idle operation, if the load is increased by some disturbance (such as by shifting from neutral to drive, turning on the air conditioner, and/or turning on the rear defogger) and the engine speed decreases, torque demand control acts in the direction to close the throttle, even though the target torque remains constant, as evident from the characteristics of FIG. 1. That is, in spite of the revolution decrease and the need for an increase in the air quantity to increase the speed again, the system decreases the air quantity and acts contrary to demand, in the idle state.

Thus, as the inventors have recognized, when idling, if the load increases due to some disturbance, the engine speed decreases, and the conventional torque demand system decreases the target generation torque in accordance with the decreased engine speed. That is, restoration of engine speed is desired, but the conventional control works in a direction to decrease the generation torque, and restoration of the engine speed may not be accomplished.

SUMMARY OF THE INVENTION

It is an object of the invention to provide an engine control system with improved operation during both normal and idling conditions, and transitions therebetween.

It is another object of the invention to provide an engine control system which operates in accordance with the driver's expectations during both normal and idling conditions.

According to the present invention, the invention provides torque in accordance with the driver's intentions and expectations and offers comfortable driveability during normal operation. At the same time, during idling operations, a type of engine torque demand control is continued. Therefore, the invention ensures continuity of control during a transition between idle and non-idle states, and avoids various problems of driveability due to a changeover step difference.

With the invention, the driver will not experience a decrease in idle speed (or a stall) when the driver turns on, for example, the air conditioner. During idle control according to the invention, the calculation of a control target quantity for the intake air quantity is based on the target idle speed instead of the actual engine speed so that the target idle speed is maintained. Also, the target generation torque can be set so as to maintain a target idle speed. This design prevents the control target quantity for the intake air quantity from being decreased when a disturbance in the form of an increased load takes place. Thus, this design achieves both improved idle control and engine torque demand control.

BRIEF DESCRIPTION OF THE DRAWINGS

The invention will be described in further detail below with reference to the drawings, wherein.

DETAILED DESCRIPTION OF PREFERRED EMBODIMENTS

First Embodiment

Figure 1:
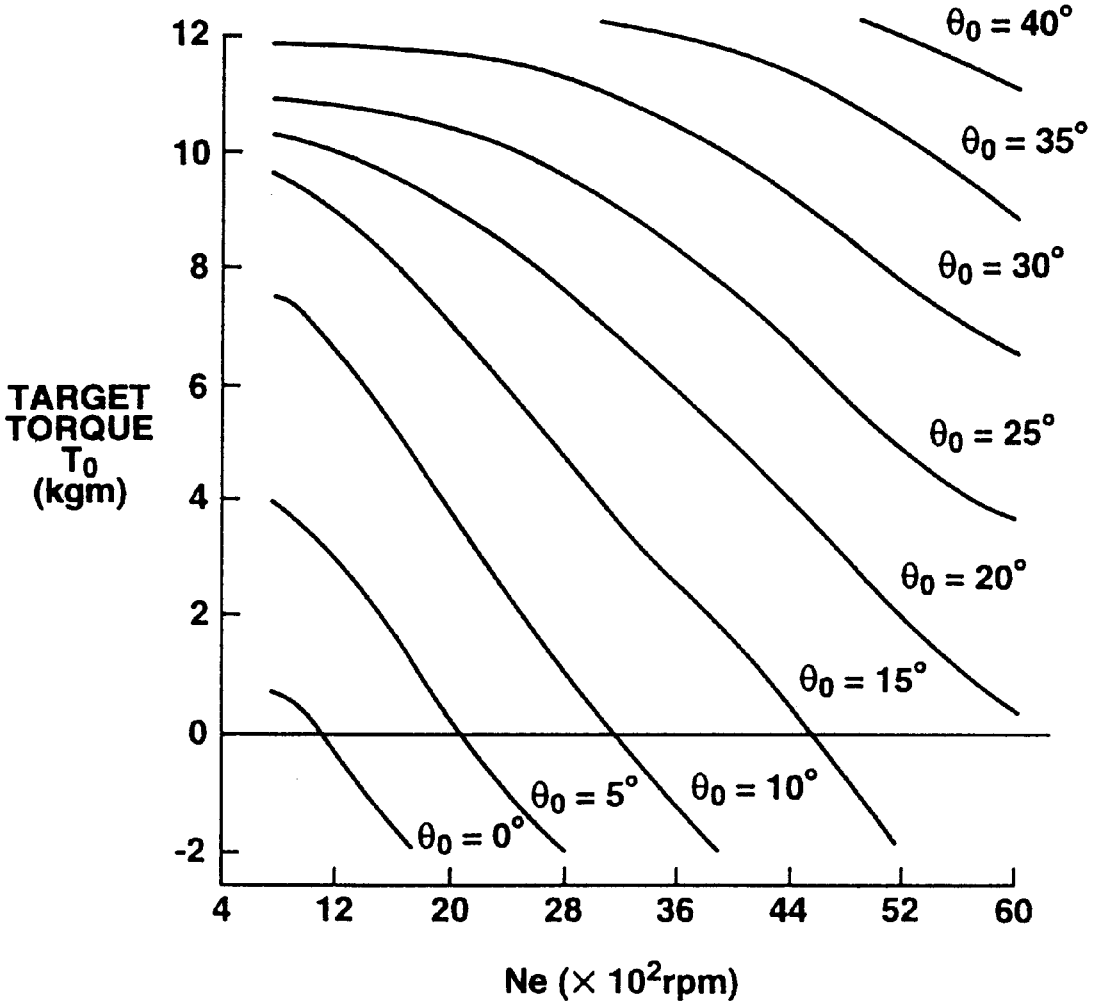
FIG. 1 illustrates one example of engine torque demand control characteristics.
Figure 2:
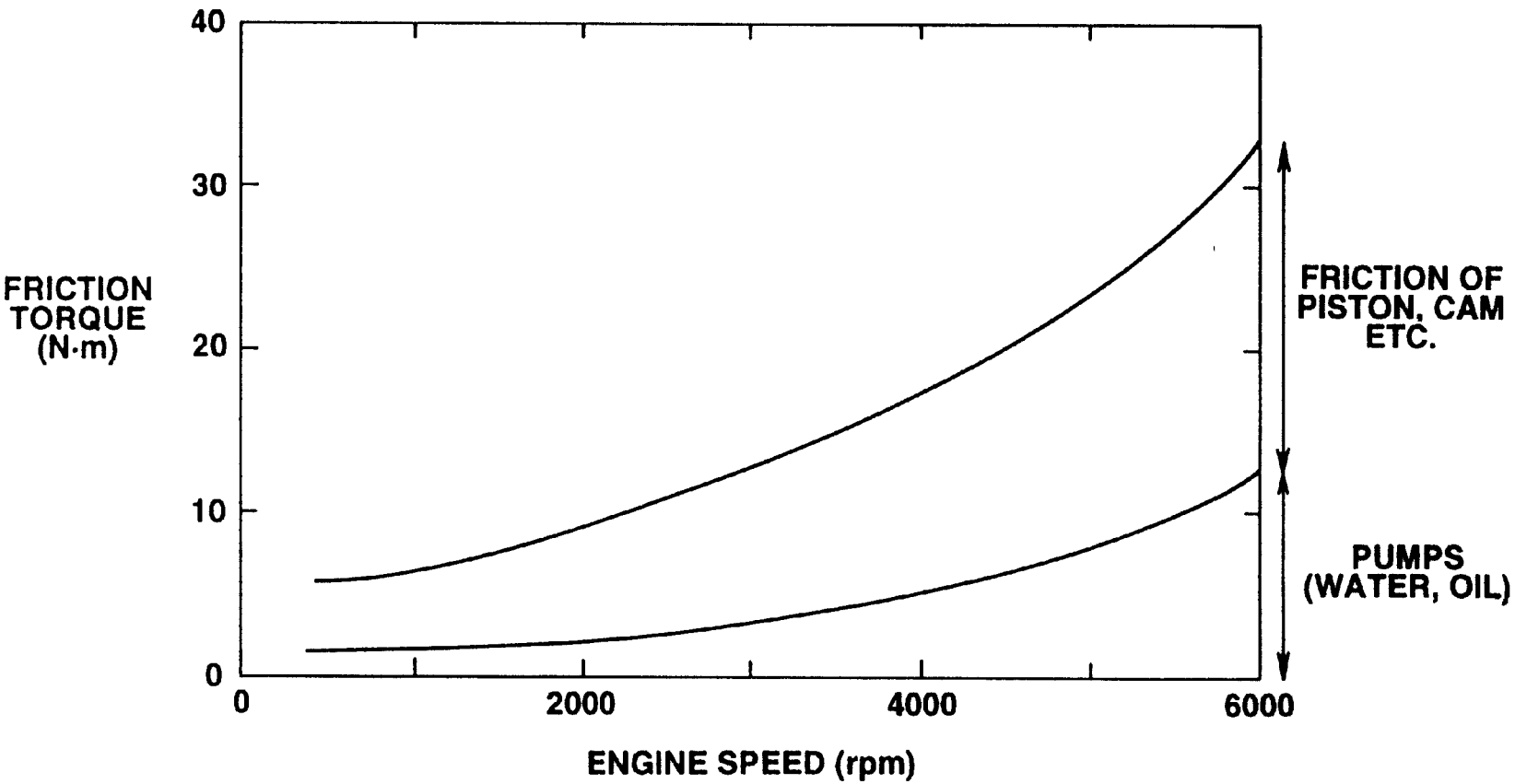
FIG. 2 are characteristics of friction torque versus engine speed.
Figure 3:
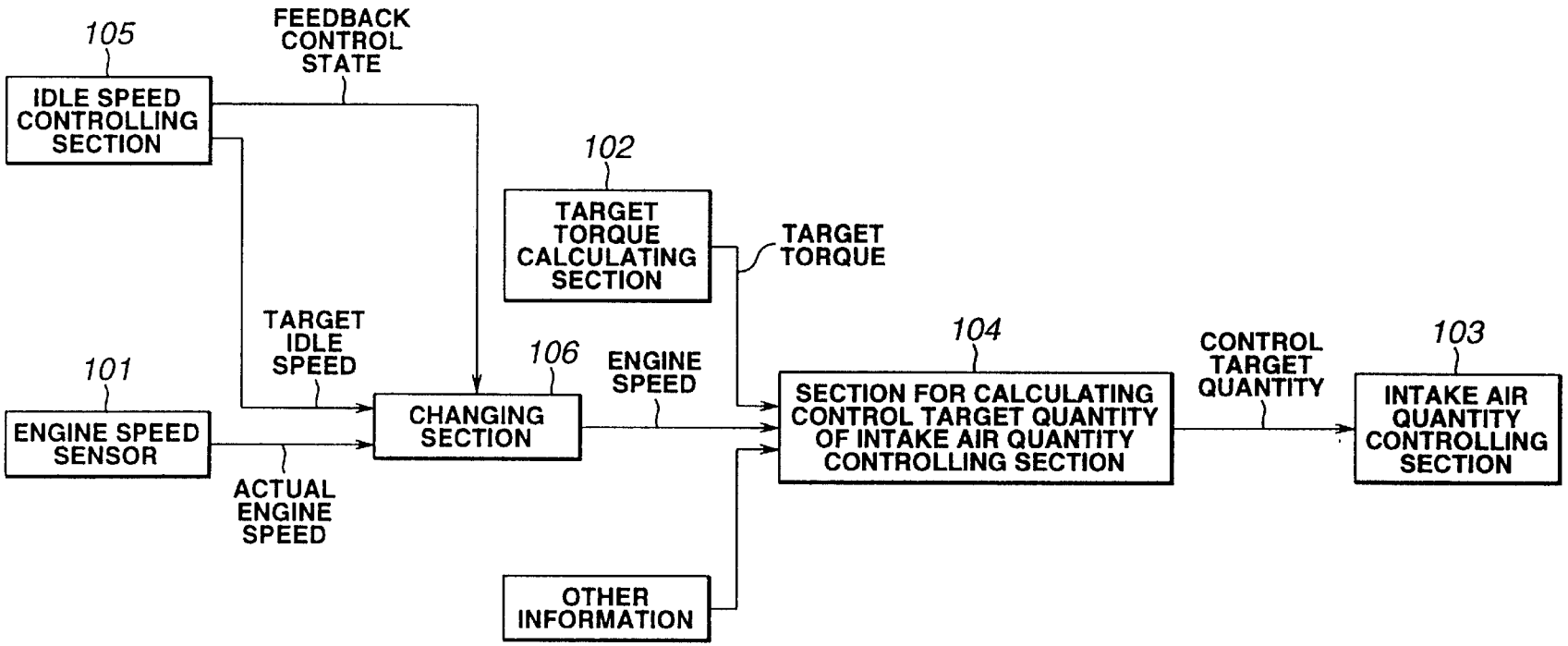
FIG. 3 is a functional block diagram showing one construction of the present invention according to a first embodiment.

FIG. 3 depicts an engine idle revolution speed control apparatus according to a first embodiment of the invention. The apparatus includes an engine revolution speed sensor 101 for sensing an actual engine revolution speed. A target torque calculating section 102 calculates a target torque to be produced by the engine using, for example, maps such as shown in FIGS. 1 and 2. An intake air quantity controlling section 103 controls an intake air quantity to a desired control target quantity. A control target quantity calculating section 104 calculates the control target quantity to be supplied to the intake air quantity controlling section. A control target quantity in the form of an intake air quantity Qa is obtained by multiplying (1) engine speed (actual engine speed during non-idling operation and target idle speed during idling operation); (2) air-fuel ratio (calculated using a map such as the one of FIG. 12); (3) required fuel quantity (which is calculated based on the fact that there is an approximately proportional relationship between torque and fuel quantity); and (4) a coefficient. An idle speed controlling section 105 performs feedback control (such as PI control (discussed below)) so as to bring the actual engine speed to a predetermined target idle speed. A changing section 106 provides, as an engine speed parameter inputted to the control target quantity calculating section, the target idle speed in place of the actual engine speed during idling control.

The sections shown herein are implemented in hardware or software or a combination of both (suitable processors are cited below).

The target torque calculating section 102 determines the target torque in the normal (that is, non-idling) operating state in accordance with the driver accelerator operation and other demands such as friction loss. Then, in accordance with the actual engine speed detected by the engine speed sensor 101 and the target torque, the control target quantity (the intake air quantity) is determined in section 104, and the intake air quantity controlling section 103 (comprising components such as a throttle valve) controls the intake air quantity. The fuel injection quantity is also determined in accordance with the target torque.

During idling operations, the idle speed controlling section 105 carries out feedback control so as to bring the actual engine speed to the target idle speed. During idle control, the target idle speed is used as the engine speed parameter instead of the actual engine speed by inputting the target idle speed through the changing section 106 to the control target quantity calculating section 104, which in turn calculates the control target quantity (the intake air quantity).

Thus, in this first embodiment, even if the load is increased due to some disturbance and the actual engine speed decreases, the control target quantity (the intake air quantity) is not decreased. Accordingly, the required intake air quantity at idling is provided so as to maintain the target idle speed.

Second Embodiment

FIGS. 4 to 13 will be used to describe a second embodiment of the invention. In this embodiment, both intake air and target torque are set based on target idle speed, during idling.

Figure 4:
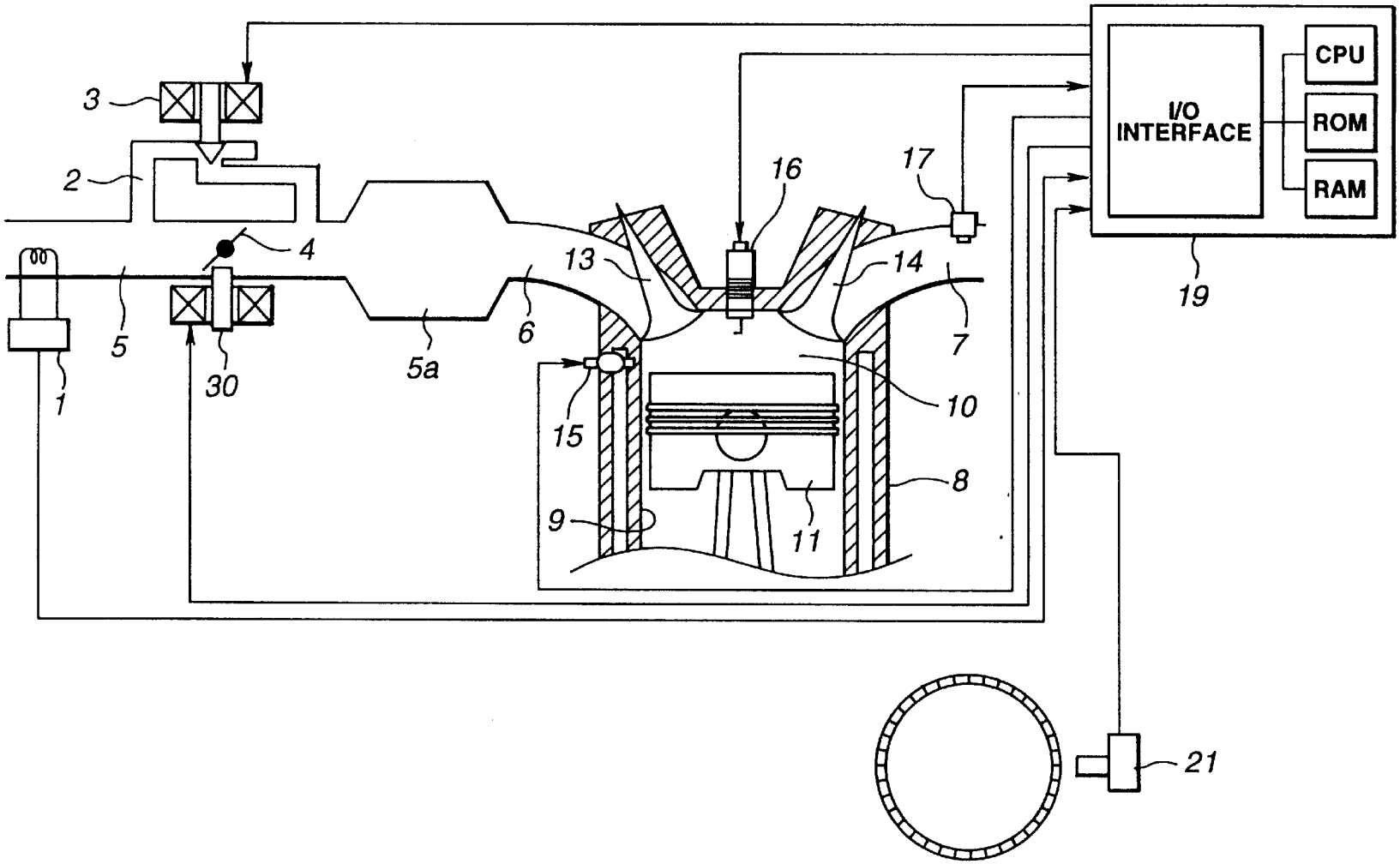
FIG. 4 illustrates a system configuration for a second embodiment of the present invention.

As shown in FIG. 4, a cylinder 9 is formed in a cylinder block 8, and a combustion chamber 10 is defined by a piston 11 slidably fit in the cylinder 9. An intake port 6 and an exhaust port 7 are connected to the combustion chamber 10. An intake valve 13 and an exhaust valve 14 are provided for opening and closing the respective ports. The upper portion of the cylinder 9 is equipped with an electromagnetic type fuel injection valve 15 for directly injecting fuel into the combustion chamber 10. An intake air passage 5 is connected through an intake collector portion 5*a* to the upstream side of the intake port 6. An ignition plug 16 is provided at the top of the cylinder.

The shown arrangement forms a direct injection type gasoline engine in which the fuel injector valve 15 injects the fuel directly into the combustion chamber 10. However, the present invention is also applicable to a port injection gasoline engine in which the fuel injection valve is disposed in the intake port 6.

A controller 19 is provided to control engine operation. The controller 19 includes the sections shown herein in the form of hardware or software or a combination of both (one type of suitable processor is cited below). In response to a command signal from the controller 19, the fuel injection valve 15 produces a homogeneous gas mixture by injecting fuel during the intake stroke, for example, in a relatively high load region, and achieves lean combustion by producing a stratified gas mixture unevenly spread in the combustion chamber by injecting fuel during the compression stroke in a low load region.

An air flowmeter 1 (of a hot wire type, for example) is provided in intake passage 5, for sensing an intake air quantity Qair. A throttle valve 4 regulates the intake air quantity in the intake passage 5. Throttle valve 4 is not directly linked with the accelerator pedal of the vehicle, but instead is arranged so that its opening degree is electronically controlled by an actuator 30 comprising a component such as a DC motor or a pulse motor. For intake air quantity control at idle, an auxiliary air passage 2 bypassing the throttle valve 4 and an auxiliary air quantity control valve 3 for controlling the flow rate in the auxiliary air passage 2 are provided. It is possible to omit the auxiliary air passage 2 and the auxiliary air quantity control valve 3 by providing more accurate intake air quantity control using the throttle valve 4 and the actuator 30.

Ignition plug 16 is disposed at the center of the combustion chamber 10 to ignite the mixture under the command of the controller 19. On the downstream side of the exhaust port 7, an air-fuel ratio sensor 17 is provided for sensing an air-fuel ratio from an oxygen concentration in the exhaust gases. A crank angle sensor 21 is provided near the crank shaft. The crank angle sensor 21 is used for sensing crank angle position and engine revolution speed. Though not shown in FIG. 4, various other sensors are provided, such as an accelerator operation quantity sensor comprising a component such as a potentiometer for sensing an accelerator operation quantity to determine driver demand, a cooling water temperature sensor for sensing the temperature condition of the engine, an intake air temperature sensor for sensing intake air temperature, and an intake pressure sensor for sensing pressure on the downstream side of the throttle valve 4.

The sensor signals from these sensors are inputted to the controller 19. The controller 19 comprises components such as an I/O interface, CPU, ROM and RAM. The controller 19 accomplishes the functions described herein by executing programs (to be described below) stored in the ROM. One suitable controller is, for example, a Hitachi SH70 series processor, programmed in C and/or machine language.

The operations of this embodiment will now be described.

The actual engine speed of the engine is detected in accordance with the output signal of the crank angle sensor 21, as is well known. For example, actual engine speed is calculated by measuring a time interval at which a reference position signal (REF signal), provided for each crank angle change of 180 degrees, is inputted to the controller 19.

Figure 5:
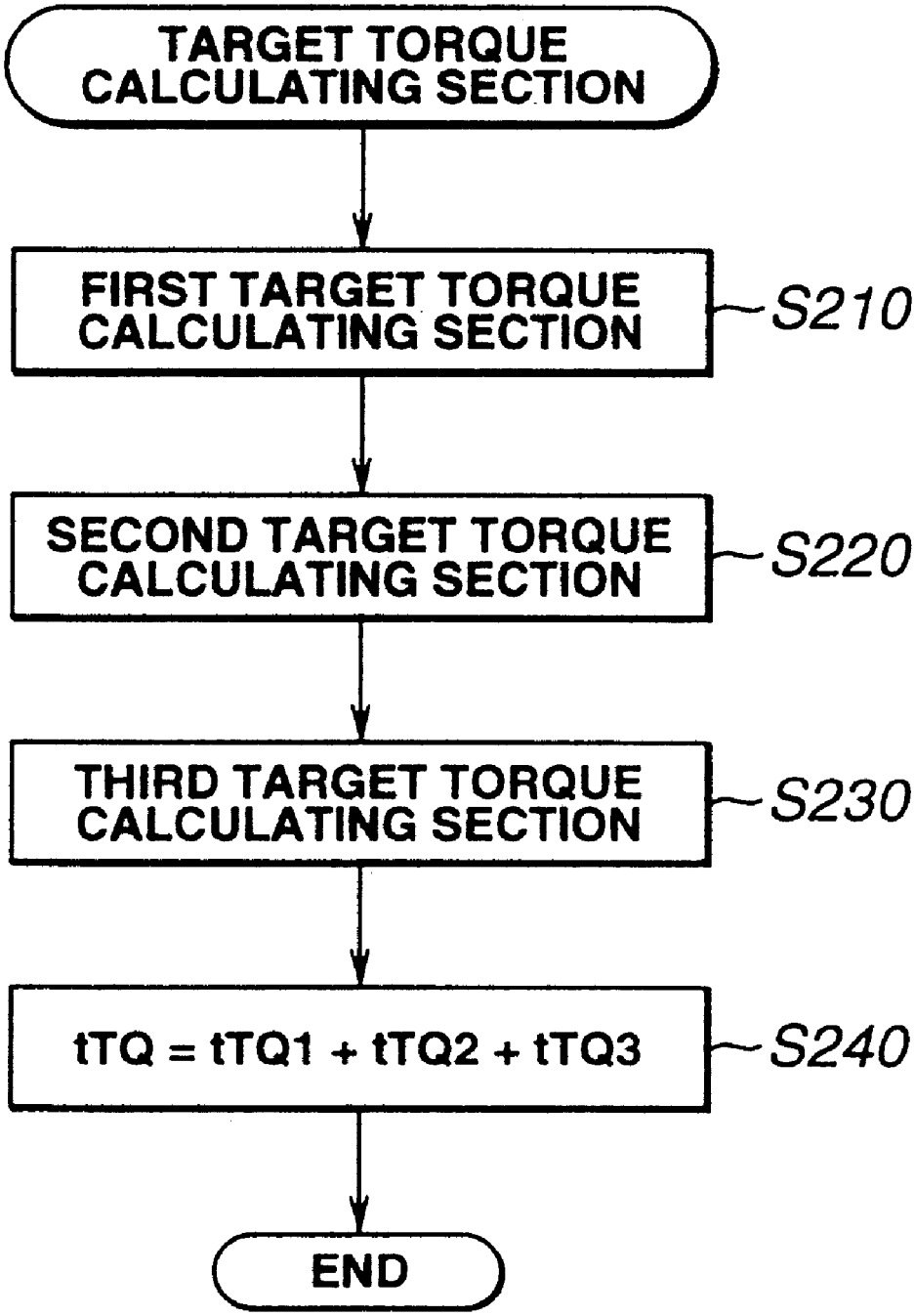
FIG. 5 is a flowchart for a target torque calculating section of the second embodiment.

A target torque calculating section (implemented in the controller 19) calculates a target torque to be produced by the engine from three target torques using the procedure shown in the flowchart of FIG. 5.

As shown in FIG. 5, a step 210 calculates a first target torque tTQ1, as explained in detail below with reference to FIG. 6. A step 220 calculates a second target torque tTQ2, as explained in detail below with reference to FIG. 7. A step 230 calculates a third target torque tTQ3, as explained in detail below with reference to FIG. 8. At a step 240, a final target torque (target generation torque) tTQ is calculated as the sum of tTQ1, tTQ2 and tTQ3, and the engine is controlled accordingly.

Figure 6:
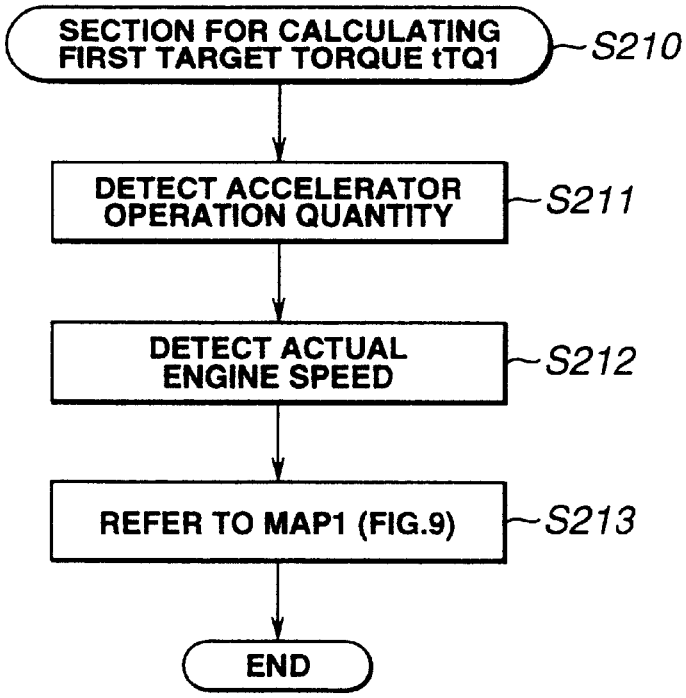
FIG. 6 is a flowchart for a first target torque calculating section of the second embodiment.

The flowchart of FIG. 6 shows the flow of operations for calculating the first target torque tTQ1.

Figure 9:
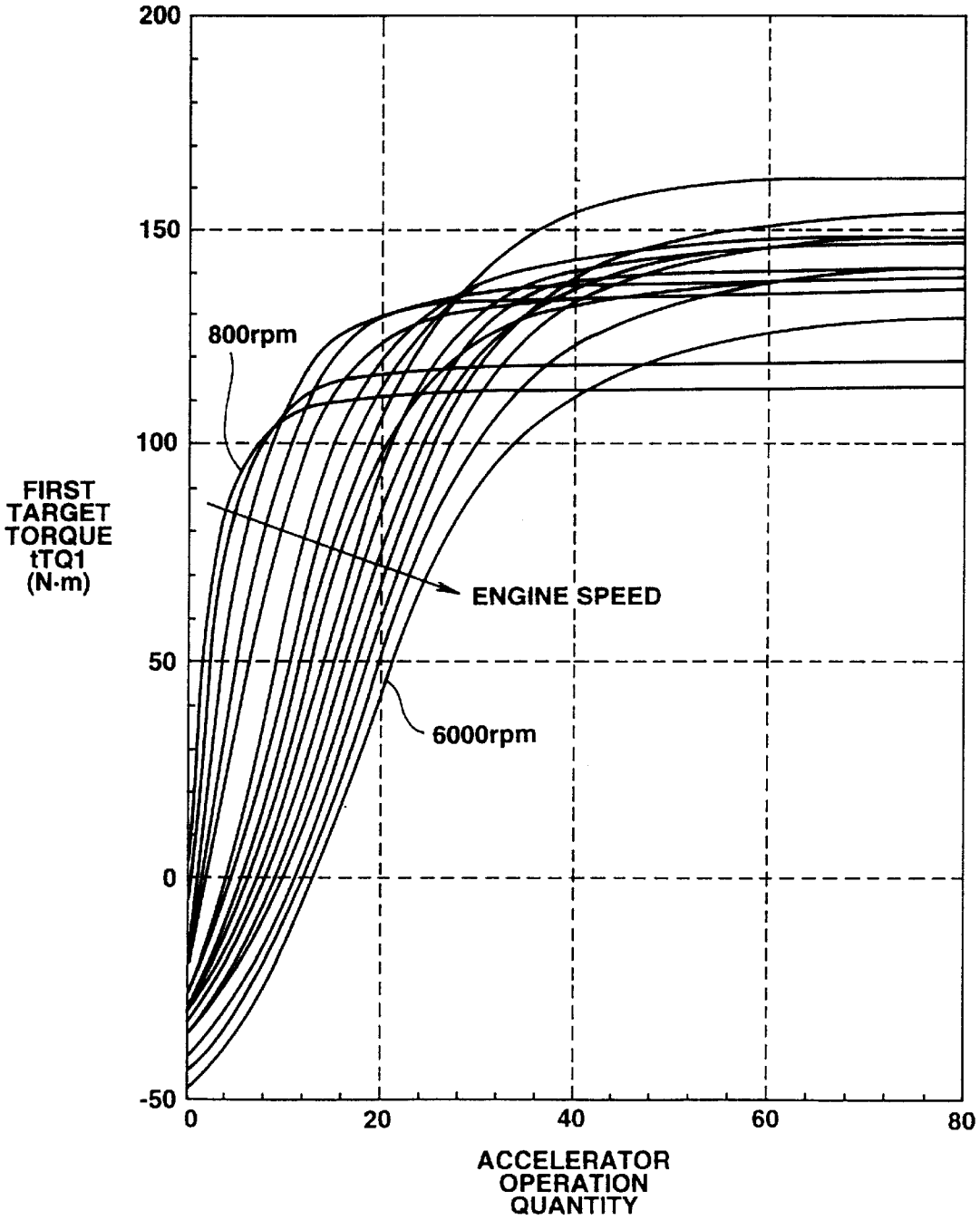
FIG. 9 are characteristics for calculation of the first target torque.

At a step 211, the accelerator operation quantity (for example, the accelerator depression by the driver) is detected in accordance with the sensor signal of the accelerator operation quantity sensor. At a step 212, the actual engine speed is detected. At a step 213, the first target torque tTQ1 is calculated from the accelerator operation quantity and the actual engine speed by searching a map such as the one shown in FIG. 9. In this example, the first target torque tTQ1 is zero at a point at which the accelerator operation quantity is zero at the idle speed (target idle speed). The negative torque region in FIG. 9 represents engine braking. This first target torque tTQ1 represents a target output torque to be outputted through the clutch and torque converter.

Figure 7:
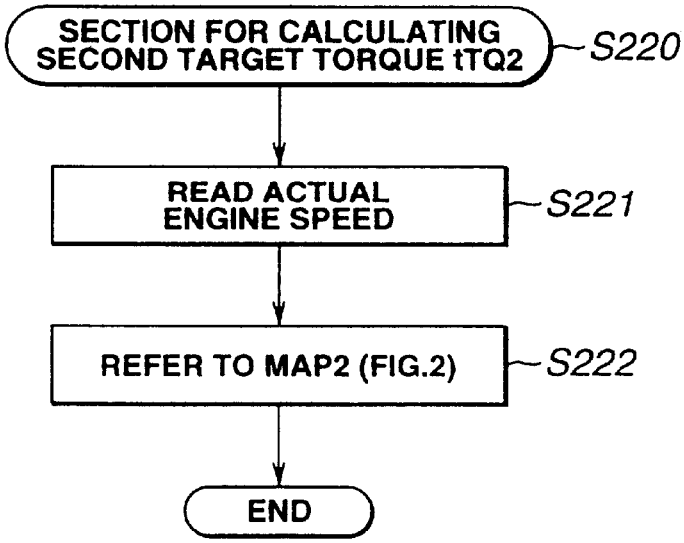
FIG. 7 is a flowchart for a second target torque calculating section of the second embodiment.

The flowchart of FIG. 7 shows the flow of operations for calculating the second target torque tTQ2.

As discussed above, loads such as friction of the engine increase in accordance with the engine speed, as shown in FIG. 2. FIG. 2 collectively shows friction loss due to pistons, cams and the like, and the load of pumps such as the water pump and oil pump. At a step 221 of FIG. 7, the actual engine speed is read. At a step 222, the second target torque tTQ2 is calculated by reference to a map storing the information shown in FIG. 2. However, since there is a tendency for the load to increase in cold operation as compared to operation after warm-up, a procedure in which a control map is preliminarily set in consideration of the engine cooling water temperature can be employed. Retrieval from such a map is carried out based on engine cooling water temperature and actual engine speed. Similarly, loads such as an air conditioner load and an alternator load, which vary in accordance with the condition of the vehicle, can be calculated, for example, from air conditioner pump pressure in the case of the air conditioner, and generated energy in the case of the alternator, and included in the second target torque tTQ2 at the step 222.

Figure 8:
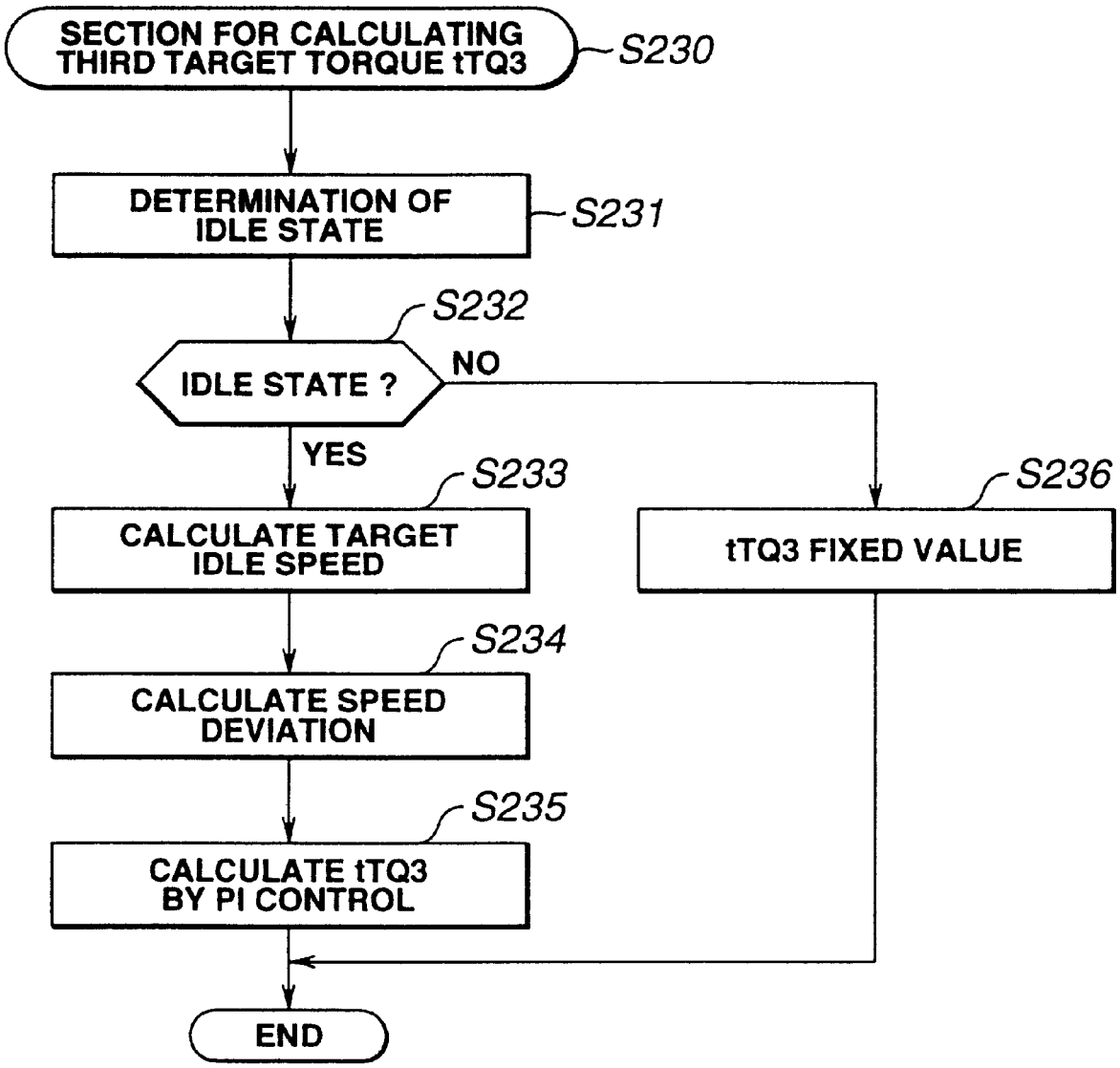
FIG. 8 is a flowchart for a third target torque calculating section of the second embodiment.

The flowchart of FIG. 8 shows the flow of operations for calculating the third target torque tTQ3.

At a step 231, a determination is made as to whether the current state is the idle control state. More specifically, a determination is made using a predetermined criterion such as a test as to whether the accelerator operation quantity is zero and the actual engine speed is equal to or lower than a predetermined speed. At a step 232, in accordance with the result of the determination of the idle state, control is transferred to a step 233 in the case of the idle control state, and to a step 236 in the case of a non-idle control state. In step 236, the third target torque tTQ3 is set equal to zero or to a predetermined value tTQ30.

Figure 10:
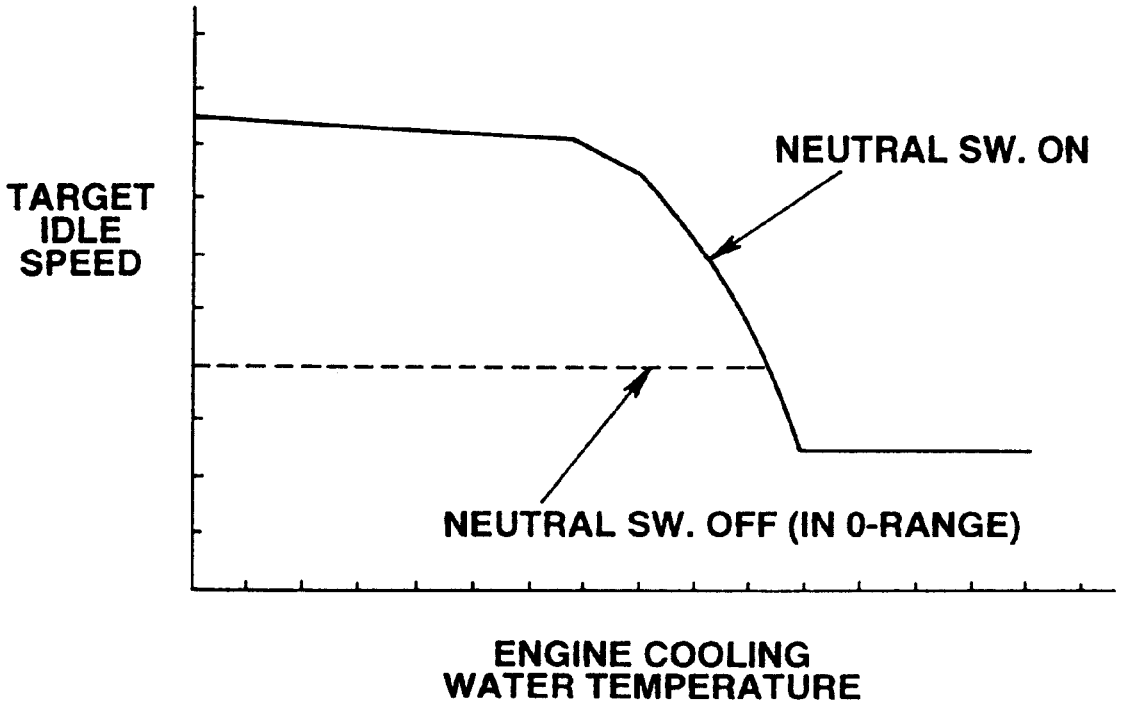
FIG. 10 illustrates how target engine idle speed varies with cooling water temperature.

At the step 233, the target idle speed in the idle state is calculated. More specifically, reference is made to a table in accordance with the engine cooling water temperature, and upper and lower limits are set by the state of the automatic transmission. An example of such a table is shown in FIG. 10. As shown in FIG. 10, because the engine operates with more stability as cooling water temperature (engine temperature) increases, as temperature increases, less inertia is needed to overcome any instability, and thus target idle speed can be reduced as temperature increases. When the neutral switch is off (meaning that the automatic transmission of the vehicle is in the drive range), the target idle speed is low so that the vehicle does not go too fast when the driver takes his or her foot off of the accelerator pedal. Also, when the neutral switch is off, the engine is generating more torque which in turn means that the engine is getting more air and is operating in a more stable condition. On the other hand, when the neutral switch is on, the engine operation is not as stable and so a higher idle speed is desired. The steep part of the curve in FIG. 10 serves to avoid certain engine resonance conditions.

At a step 234, a deviation between the target idle speed and the actual engine speed is calculated. At a step 235, the third target torque tTQ3 is calculated using PI (proportional-integral) feedback control such that the actual engine idle speed settles down to the target idle speed. The basic theory and techniques of PI control are well known in the field of automotive control. The PI output has one component (the proportional component) which is proportional to the speed deviation and another component (a time integral component) which reflects the recent history of the speed deviation. These two components are summed together (after gains are applied).

From the thus-obtained first, second, and third target torques tTQ1 to tTQ3, the final target torque is calculated, as discussed above in connection with FIG. 5.

Variable control of the engine intake air quantity is achieved, by controlling the opening degree of the throttle valve 4 via the actuator 30. At idle, the auxiliary air quantity control valve 3 can be controlled in combination with valve 4.

Figure 11:
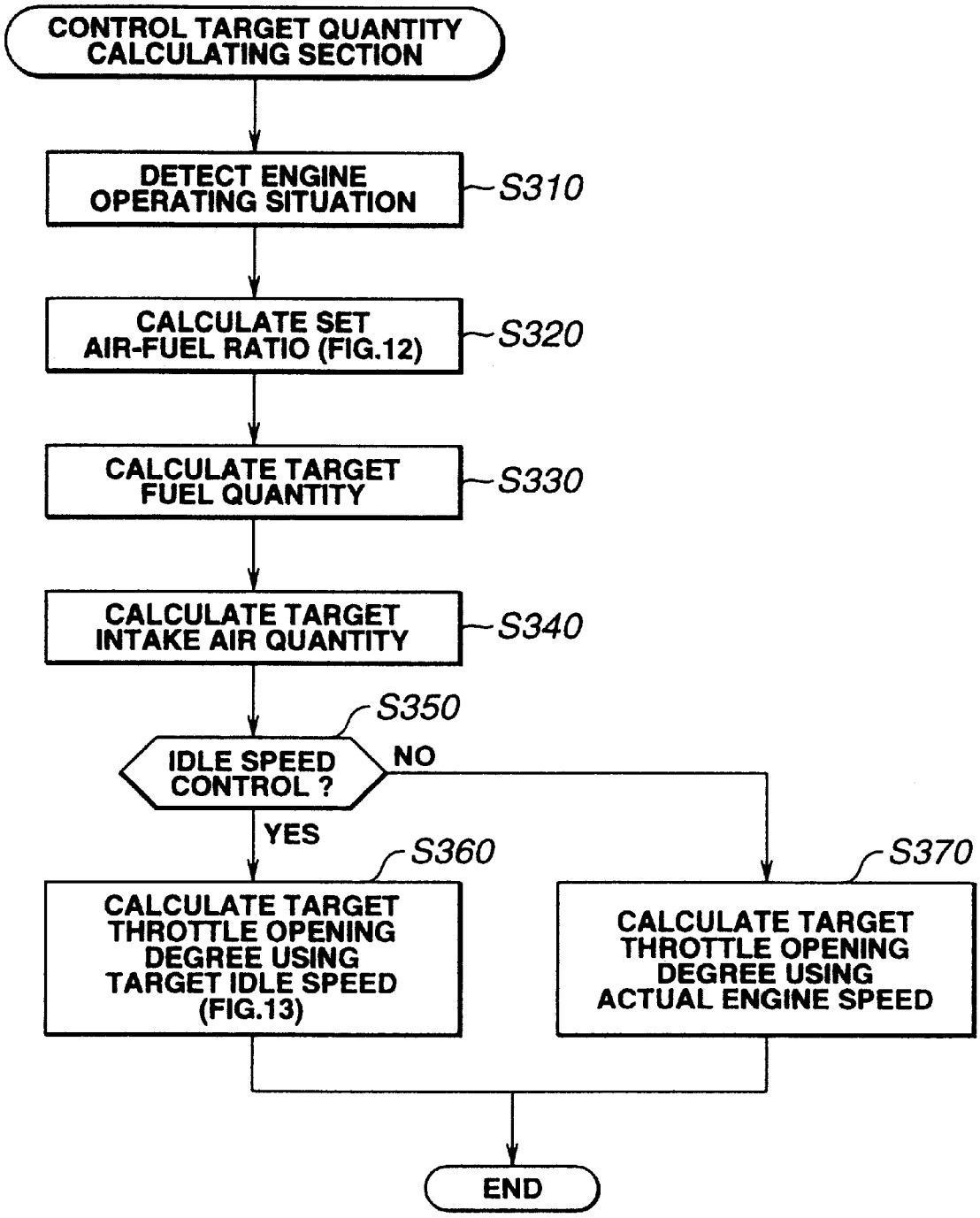
FIG. 11 is a flowchart for calculating target throttle opening degree for the second embodiment.

The target throttle opening degree of the throttle valve 4 is determined in a control target calculating section by the procedure set forth in the flowchart of FIG. 11.

Figure 12:
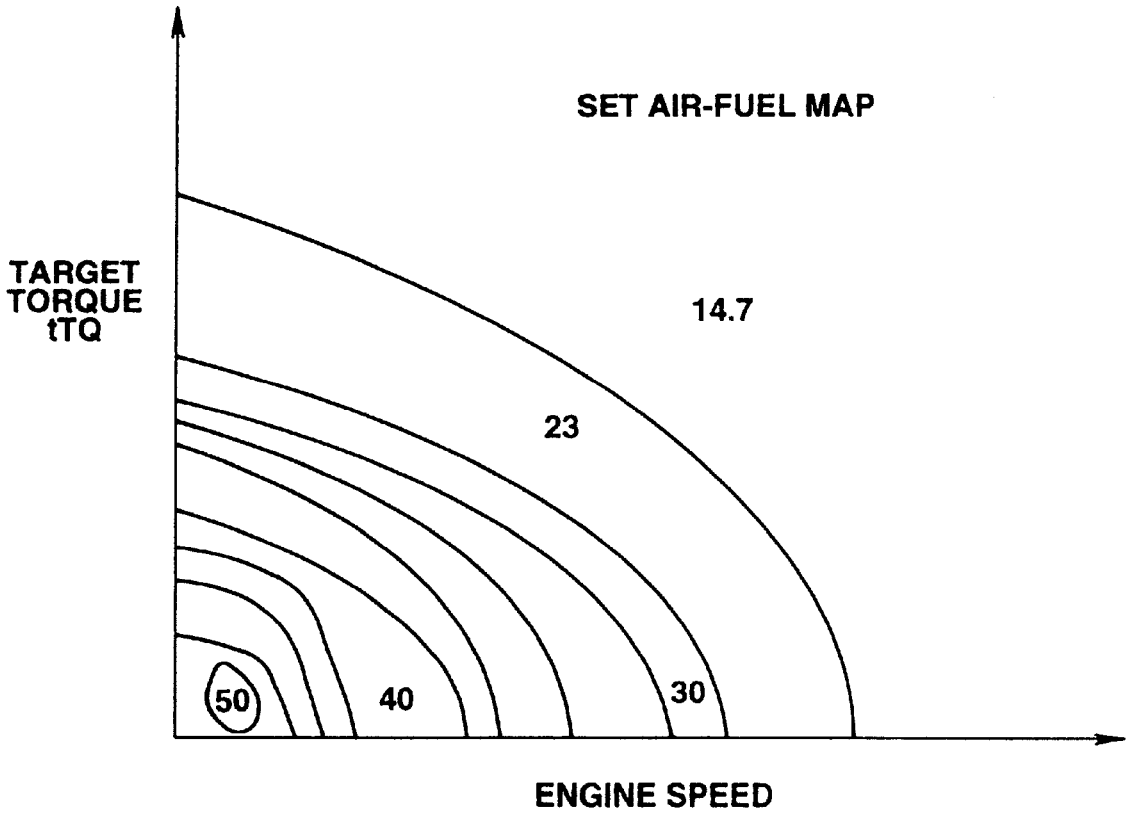
FIG. 12 are characteristics of a set air-fuel ratio map.

First, at a step 310, the engine operating situation is determined, such as the target torque tTQ and the actual engine speed. At a step 320, based on the engine operating situation, reference is made to an air-fuel ratio map of predetermined characteristics such as the one shown as an example in FIG. 12. (FIG. 12 is an example of a map used after warm-up.) FIG. 12 provides a set air-fuel ratio corresponding to the engine operating situation. At a step 330, a target fuel injection quantity is calculated in accordance with the target torque tTQ. In general, as discussed above, generated torque and fuel injection quantity are in an approximately proportional relationship. According to this relationship, the target fuel injection quantity is calculated in accordance with the target torque tTQ.

Figure 13:
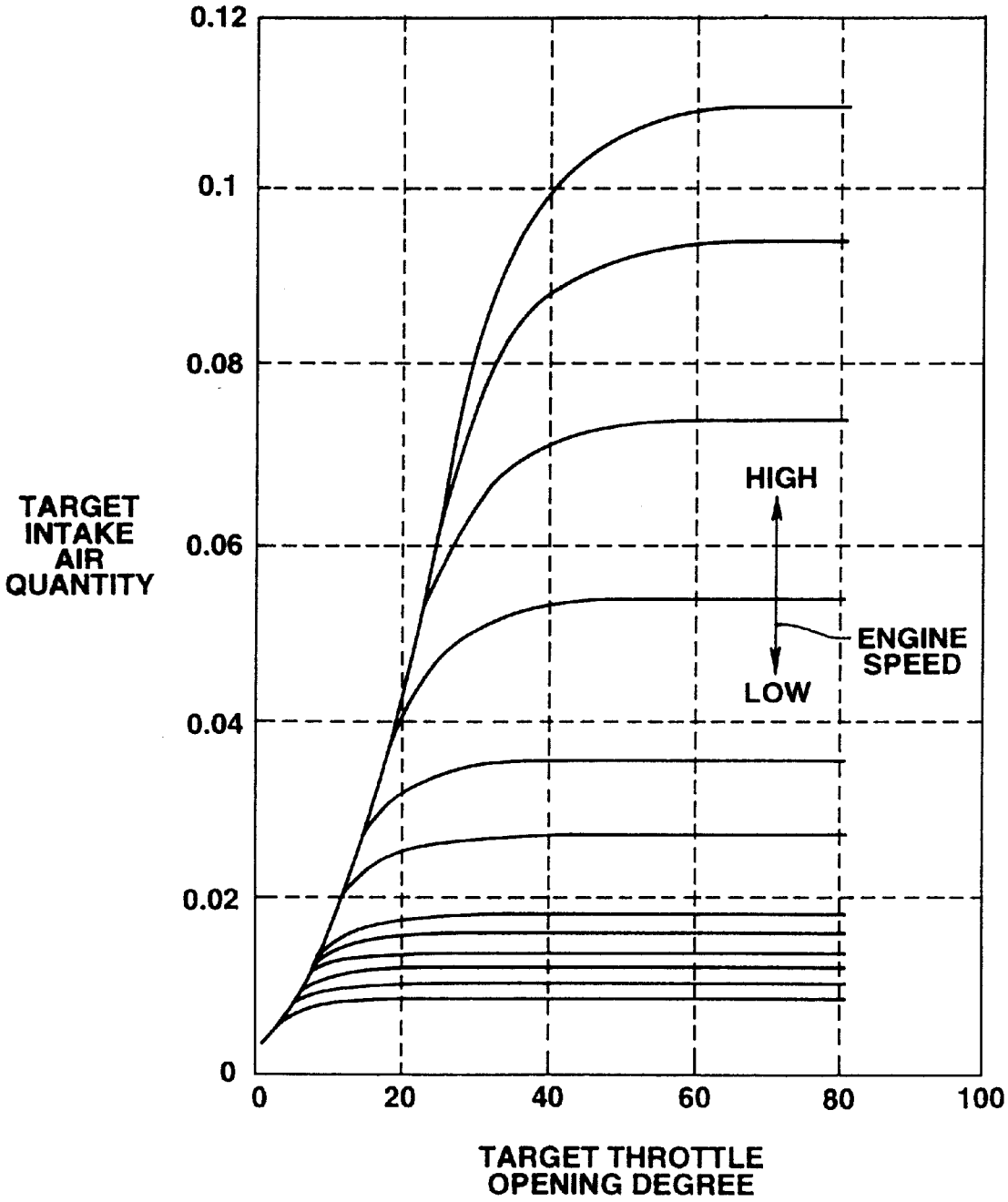
FIG. 13 are characteristics for calculating the target throttle opening degree from the target intake air quantity.

At a step 340, from this target fuel injection quantity, the set air-fuel ratio, and the actual engine speed, a target intake air quantity is calculated. Basically, as discussed above, this target intake air quantity is obtained by multiplication of the above-mentioned three parameters and by further multiplying this quantity by a coefficient. At a step 350, a determination is made as to whether the engine is in the idle speed control operating condition. If the engine is in the idle control condition, the target throttle opening degree is calculated from a curve such as shown in FIG. 13 using the target idle speed, in step 360. Otherwise, target throttle opening degree is calculated from FIG. 13 using actual engine speed, in step 370. In the FIG. 13 example, target throttle opening degree is set in accordance with steady state characteristics. However, target throttle opening degree can be set in consideration of dynamics such as intake air transportation lag in the intake system.

In FIG. 11, the air-fuel ratio and the target intake air quantity are determined based on actual engine speed. However, target idle speed can be used in place of actual engine speed in steps 320 and 340. Also, the control accuracy can be further refined by adding corrections for parameters such as atmospheric pressure, intake air temperature, intake air pressure, EGR rate, target air-fuel ratio, operating position of the intake control valve, operating position of any valve timing varying mechanism for a swirl control valve and intake and exhaust valves, and a control position of an evaporator control valve. These correction methods can be provided using correction coefficients respectively prepared for the characteristics of FIG. 13 (which is calculated on the assumption that conditions are constant) and performing multiplication using the correction coefficients, or by solving a state equation of a model of the intake system including the above-mentioned various parameters. Similar corrections can be made to the other maps and tables discussed herein, to improve the robustness of the control as the environment changes.

The above procedure performs engine torque demand type of control. According to the above technique, in the calculation of the third target torque tTQ3 during idle speed control, as shown in FIG. 8, when the determination of step 232 is that the idle control state exists, the above-described operations are performed by steps 233 to 235, and also the target idle speed obtained by the step 233 is used in place of the actual engine speed for calculation of the target throttle opening degree.

In the idle control state, this technique prevents the target throttle opening degree from being decreased when the load increases due to some disturbance and the actual engine speed decreases, and thereby ensures the intake air quantity needed to maintain the target idle speed. Consequently, this technique enables stable idle speed control.

Third Embodiment

In the second embodiment, when idle control is started, the engine speed used as the basis for calculation of the target throttle opening degree is immediately changed from the actual engine speed to the target idle speed. Consequently, the calculated target throttle opening degree is changed in a stepwise manner. This could cause an abrupt decrease in the target torque and be a factor causing an abrupt decrease of speed. This third embodiment is devised to start idle control from a relatively high engine speed, and to successively generate transient target engine speeds so as to smoothly transition from the initial engine speed to a final target idle speed, and to control the engine revolution speed in conformity with these transient target engine speeds.

Figure 14:
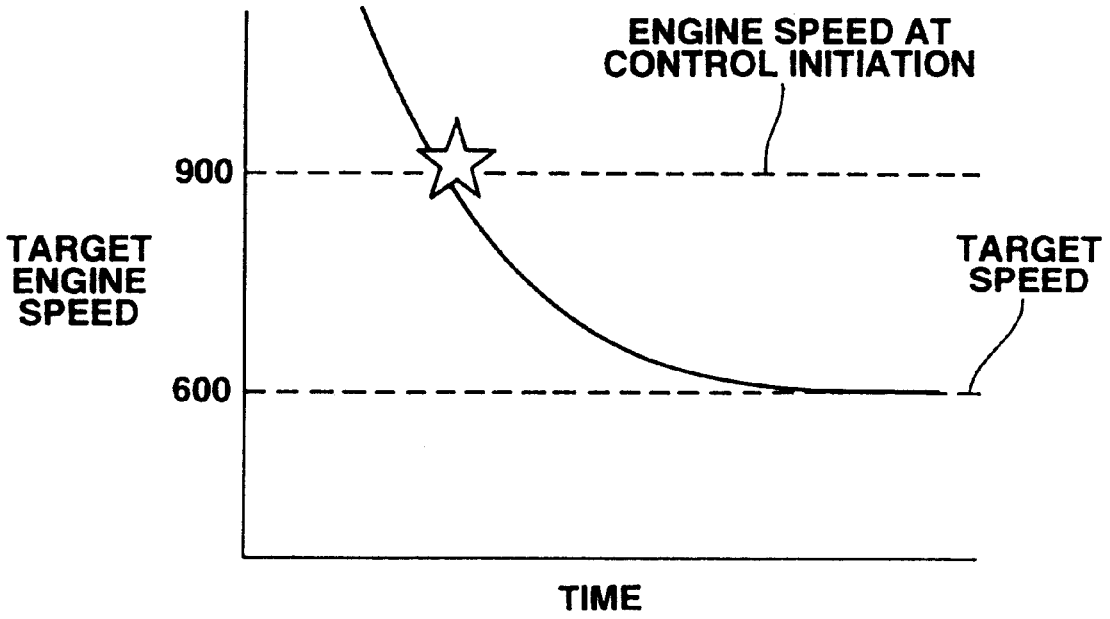
FIG. 14 illustrates target engine speed during a transient condition according to a third embodiment of the invention.

FIG. 14 shows an example of target engine speeds during a transient, according to a third embodiment of the invention. In this example, idle control is initiated at 900 rpm and transient target engine speeds are generated to gradually reach a target idle speed of 600 rpm. In the FIG. 14 example, the transient target engine speeds are generated using a first order delay function of:

$$900-300/(TS+1)$$

wherein:

S is the Laplace operator; and

T is a time constant (for example 1 second). These transient target engine speeds can be used instead of the target idle speed in any of the operations discussed above that make use of target idle speed. This technique also allows idle control to be started earlier.

Fourth Embodiment

Figure 15:
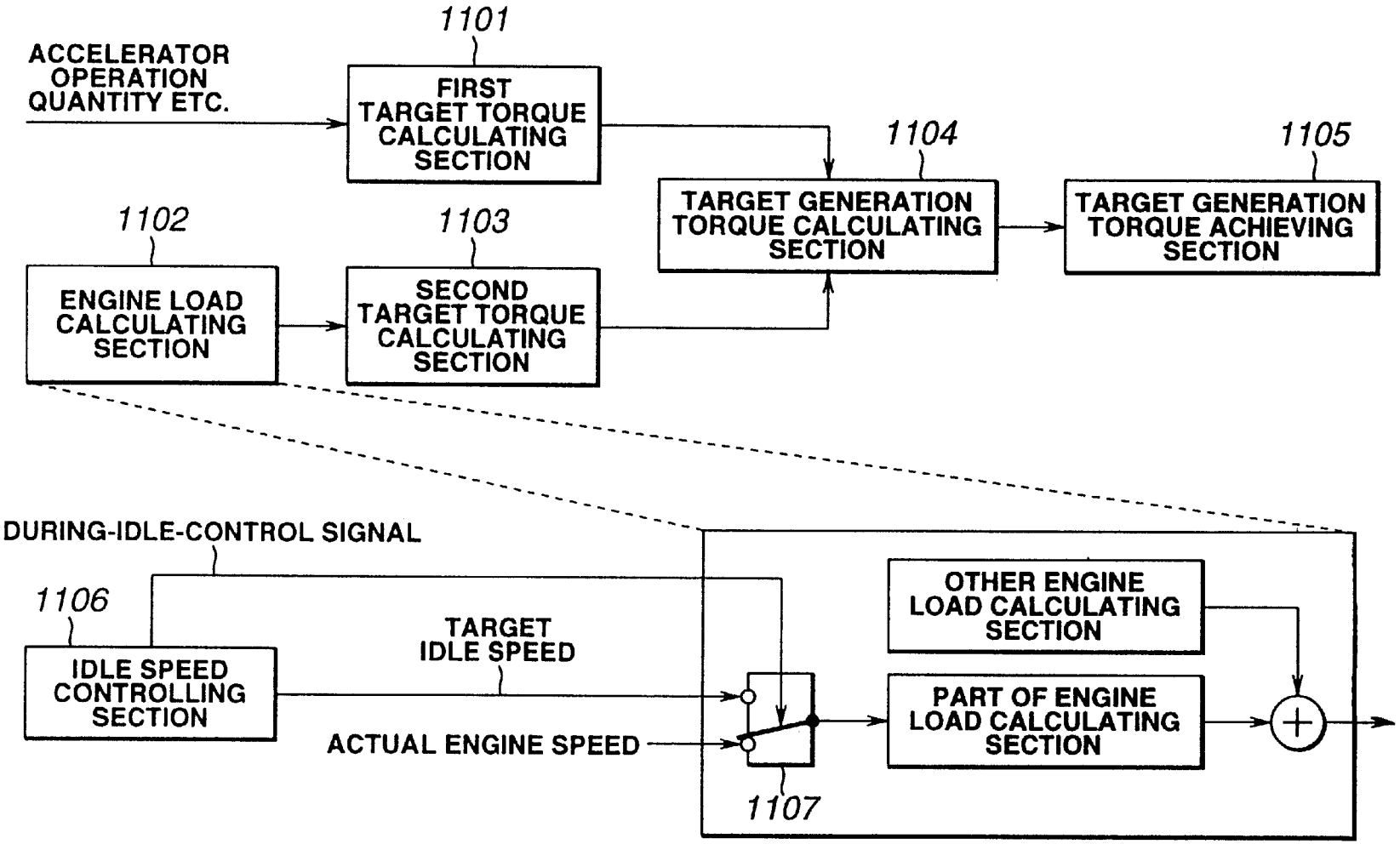
FIG. 15 is a functional block diagram of a fourth embodiment of the invention.

FIG. 15 illustrates an engine idle revolution speed control apparatus according to a fourth embodiment of the invention.

A first target torque calculating section 1101 calculates a first target torque for the engine in accordance with a driver's request. An engine load calculating section 1102 calculates an engine load for loads such as loads of accessory unit(s) and engine friction. A second target torque calculating section 1103 calculates a second target torque based on the engine loads. A target generation torque calculating section 1104 calculates a target generation torque for the engine from the first and second target torques. A target generation torque achieving section 1105 controls a torque related parameter, such as engine intake air quantity, fuel injection quantity and ignition timing, so as to achieve the target generation torque.

An idle speed controlling section 1106 serves to modify the target generation torque, by modifying the second target torque, so as to maintain a predetermined target idle speed when the engine is in the idle control state. Section 1106 does this by generating a target idle speed and a control signal which indicates when the engine is in an idling control condition. A changing section 1107 provides as an engine speed parameter serving as the basis for calculation of load in the engine load calculating section, the target idle speed in place of the actual engine speed during idle control of the engine.

In the normal operating (that is, non-idling) state, the first target torque is determined in accordance with the driver's request (such as driver accelerator operation). The second target torque is determined based on engine friction resistance and the like. The target generation torque of the engine is a sum (or other function) of both torques. To achieve this target generation torque, the system controls a torque related parameter of the engine such as engine intake air quantity and/or fuel injection quantity. By this technique, the actual engine generation torque is controlled in accordance with the target generation torque.

By thus separating (1) the driver's requested torque and (2) internally consumed torque (such as friction), the system uses, as a reference value for control, an engine torque which is the physical quantity directly acting on the control of the vehicle. Therefore, the system responds as the driver expects. In other words, the system takes into account and compensates for internally consumed torque so that the vehicle actually responds in accordance with the torque demanded by the accelerator depression.

During idle operations, the idle speed controlling section 1106 serves to modify the target generation torque so as to maintain a predetermined target idle speed. Even during idling operations, the control system operates according to the principles of engine torque demand control. The control system operates according to the principles of engine torque demand control not only for the driving state (non-idle state) but also for the idling state. Thus, continuity of control during transitions between the idle state and the non-idle state is assured and driveability problems during the changeover are avoided.

During idle control, the target idle speed is supplied instead of the actual engine speed as the engine speed parameter through the changing section 1107 for engine load calculation in section 1102. Because of this changeover to the target idle speed, the system calculates, as a target value, a torque required to maintain the target idle speed so that, even if the engine speed is temporarily decreased by some disturbance during idling, the control system prevents a corresponding decrease of target generation torque and instead acts in a direction to restore target speed.

Figure 16:
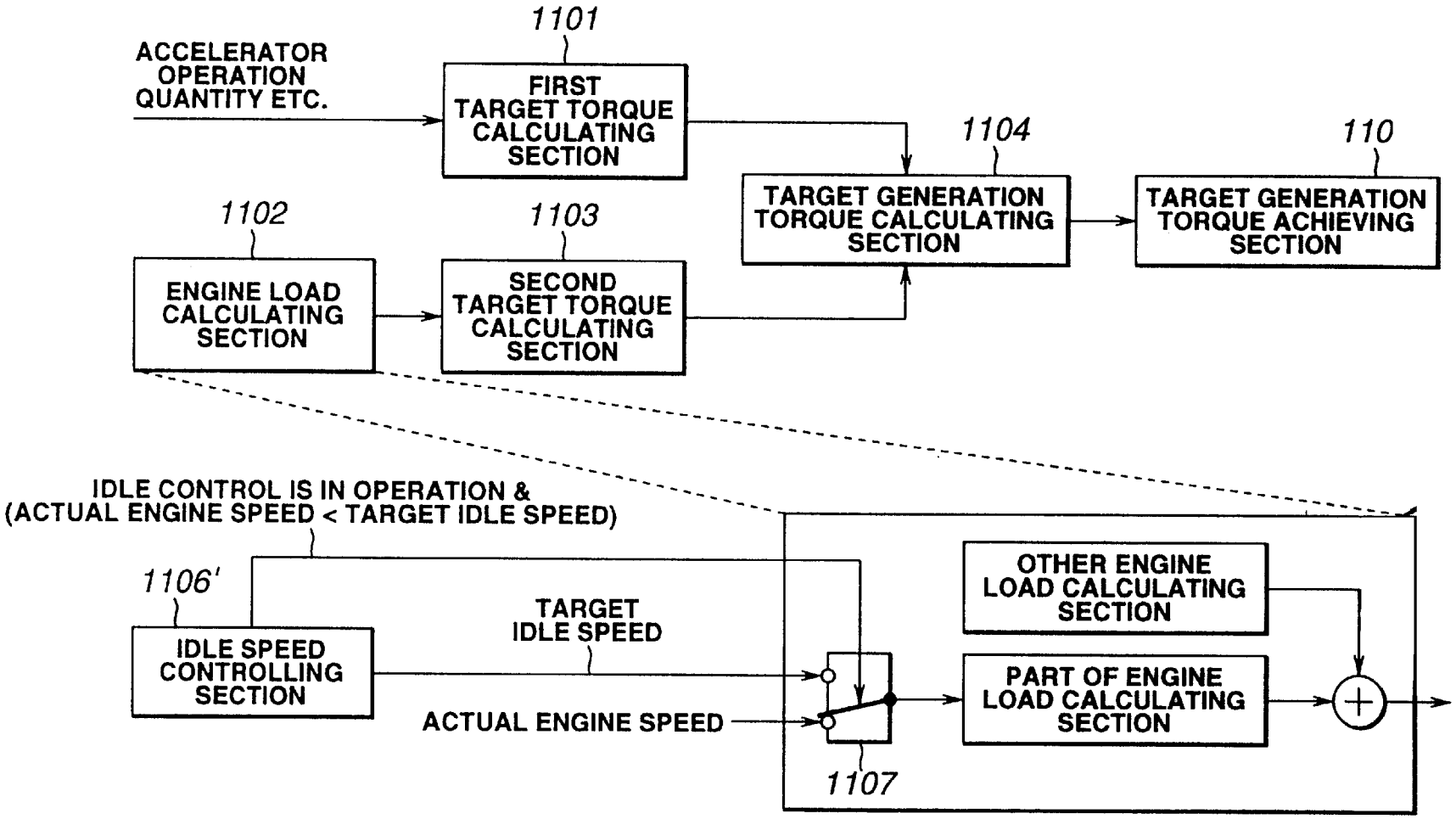
FIG. 16 is a functional block diagram of a modification of the fourth embodiment of the invention.

FIG. 16 illustrates a modification of the FIG. 15 design. In the FIG. 16 design, idle speed controlling section 1106' controls section 1107 such that the target idle speed is used in place of the actual engine speed when the actual engine speed becomes lower than the target idle speed during idle control of the engine by the idle speed controlling section.

Thus, this modification replaces the actual engine speed with the target idle speed only when the actual engine speed becomes lower than the target idle speed. This arrangement also prevents the target generation torque from being decreased by a decrease of the engine speed due to some disturbance, and also causes the control system to work in the direction to restore the engine speed to the target speed.

Fifth Embodiment

FIGS. 17 to 20 will be used to explain a fifth embodiment.

In this embodiment, target generation torque is calculated from two target torques.

Figure 17:
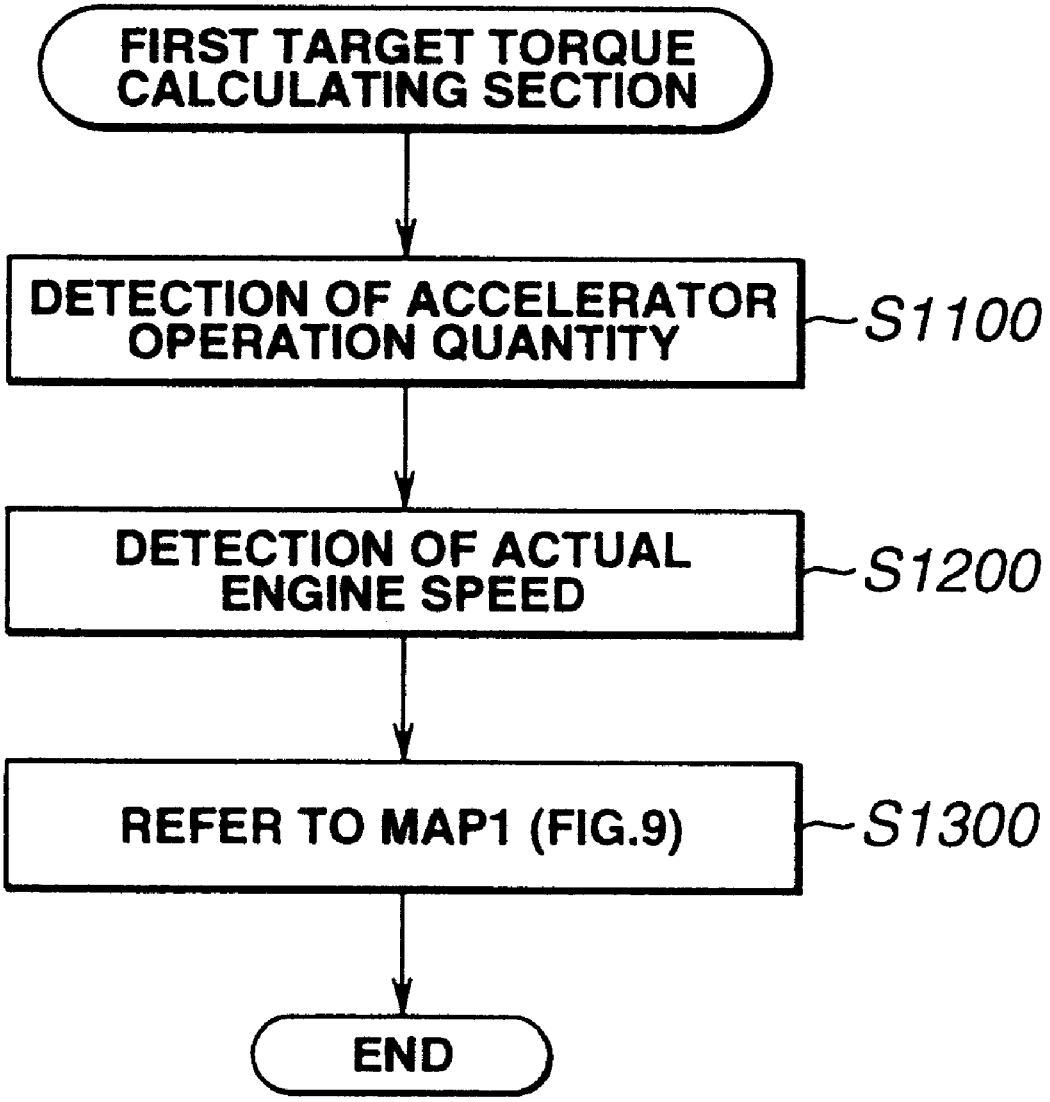
FIG. 17 is a flowchart for a first target torque calculating section according to a fifth embodiment of the invention.

The flowchart of FIG. 17 shows the flow of operations for calculating the first target torque in a first target torque calculating section.

At a step 1100, the accelerator operation quantity of the driver is detected in accordance with a sensor signal from an accelerator operation quantity sensor. At a step 1200, the actual engine speed is detected. The actual engine speed is detected in accordance with an output signal from a crank angle sensor (such as sensor 21 in FIG. 4). At a step 1300, the first target torque is calculated from the accelerator operation quantity and the actual engine speed by searching a map such as shown in FIG. 9. This first target torque represents a target torque (target output torque) to be outputted through the clutch and torque converter.

The engine load includes internal loads such as friction resistance of the engine and accessory loads such as an air conditioner load and an alternator load, as discussed above in connection with FIG. 2.

The second target torque is determined as a torque having a value to balance the calculated engine load. These calculations will be described with reference to FIG. 18.

First, at a step 3100, it is determined whether idle control is under way. When idle control is in operation, the system proceeds to a step 3200 and reads a predetermined target idle speed as an engine speed parameter. Target idle speed can be calculated as described above in connection with FIG. 10. When idle control is not in operation, that is when normal driving is under way, the system proceeds to a step 3300 and reads the actual engine speed as the engine speed parameter. At a step 3400, the engine load is calculated based on the target idle speed or the actual engine speed using a table or map having predetermined characteristics, such as the one shown in FIG. 2.

Therefore, during idle control, even when the load is increased by some disturbance and the actual engine speed is decreased, the invention calculates the engine load based on the target idle speed and calculates a target generation torque corresponding to this. Therefore, the control acts in a direction to restore the speed, and enables stable idle control.

Figure 18:
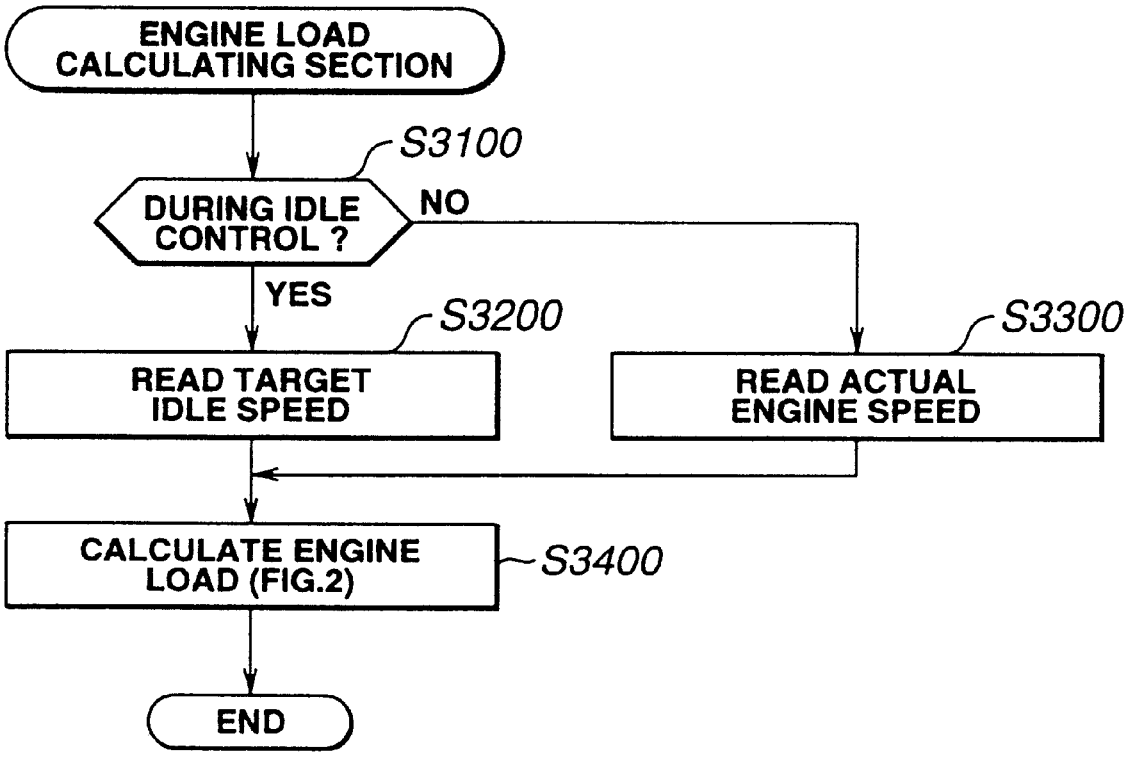
FIG. 18 is a flowchart for an engine load calculating section according to the fifth embodiment.
Figure 19:
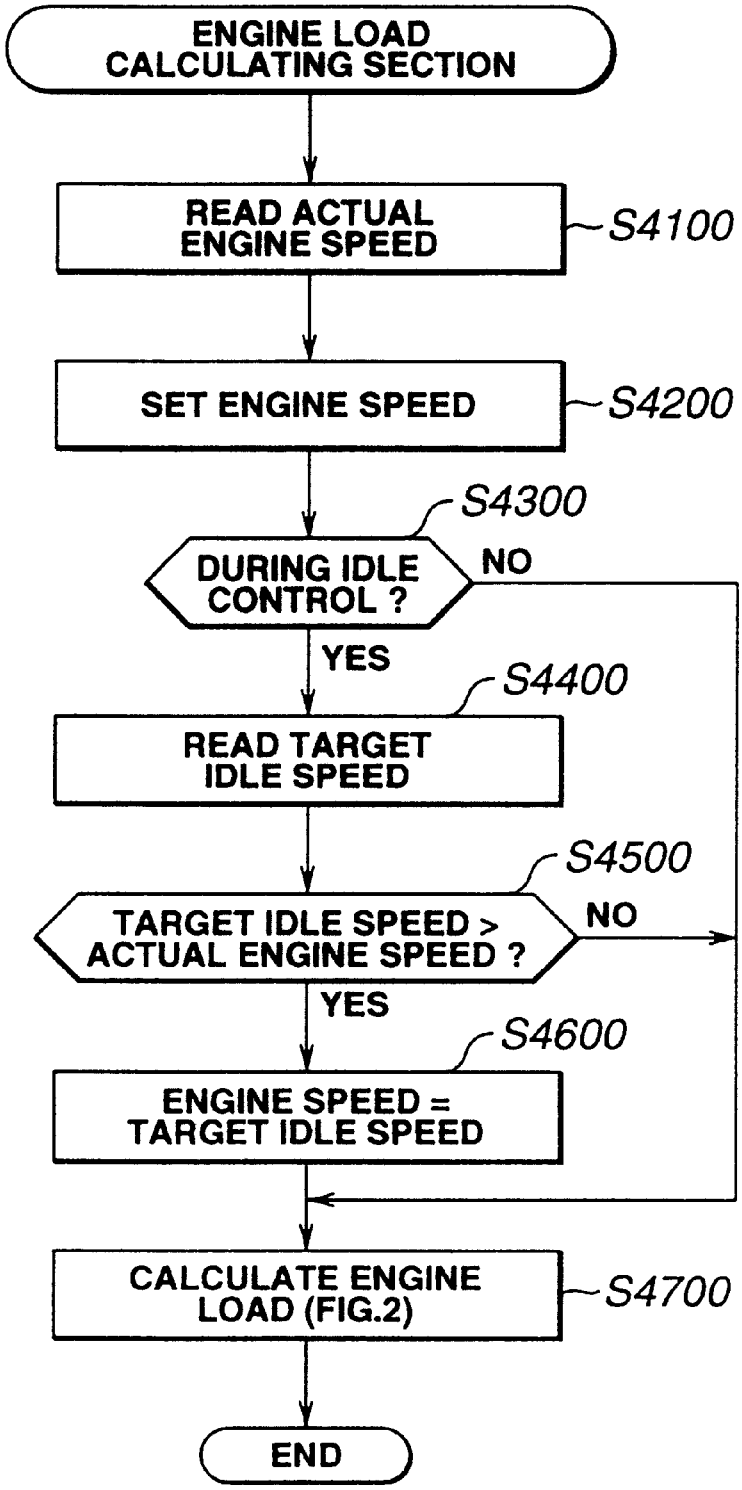
FIG. 19 is a flowchart for another engine load calculating section according to the fifth embodiment.

FIG. 19 illustrates an alternative procedure to the procedure of FIG. 18.

In the flowchart of FIG. 19, the actual engine speed is read at a step 4100, and this actual engine speed is set at a step 4200 as the engine speed parameter used for calculation of the engine load in a later-described step 4700. At a step 4300, it is determined whether idle control is in progress. When idle control is not in operation, the processing proceeds to step 4700. When it is determined that idle control is in progress, the processing proceeds to a step 4400 and reads the target idle speed. At a step 4500, the system compares the target idle speed and the actual engine speed, and proceeds to step 4700 when the actual engine speed is equal to or higher than the target idle speed. Otherwise, the system proceeds to step 4600, which resets the target idle speed as the engine speed parameter used for calculation of the engine load at step 4700. At step 4700, the system calculates the engine load in the same manner as in the step 3400 using the thus-determined engine speed parameter. Therefore, like the FIG. 18 procedure, during idle control, even when the load is increased by some disturbance and the actual engine speed is decreased, the system calculates the engine load based on the target idle speed and calculates the target generation torque corresponding to this. Therefore, the control acts in the direction to restore the speed, and enables stable idle control.

The final target generation torque is calculated as the sum of the first target torque (FIG. 17) and the second target torque (FIGS. 18 or 19).

Figure 20:
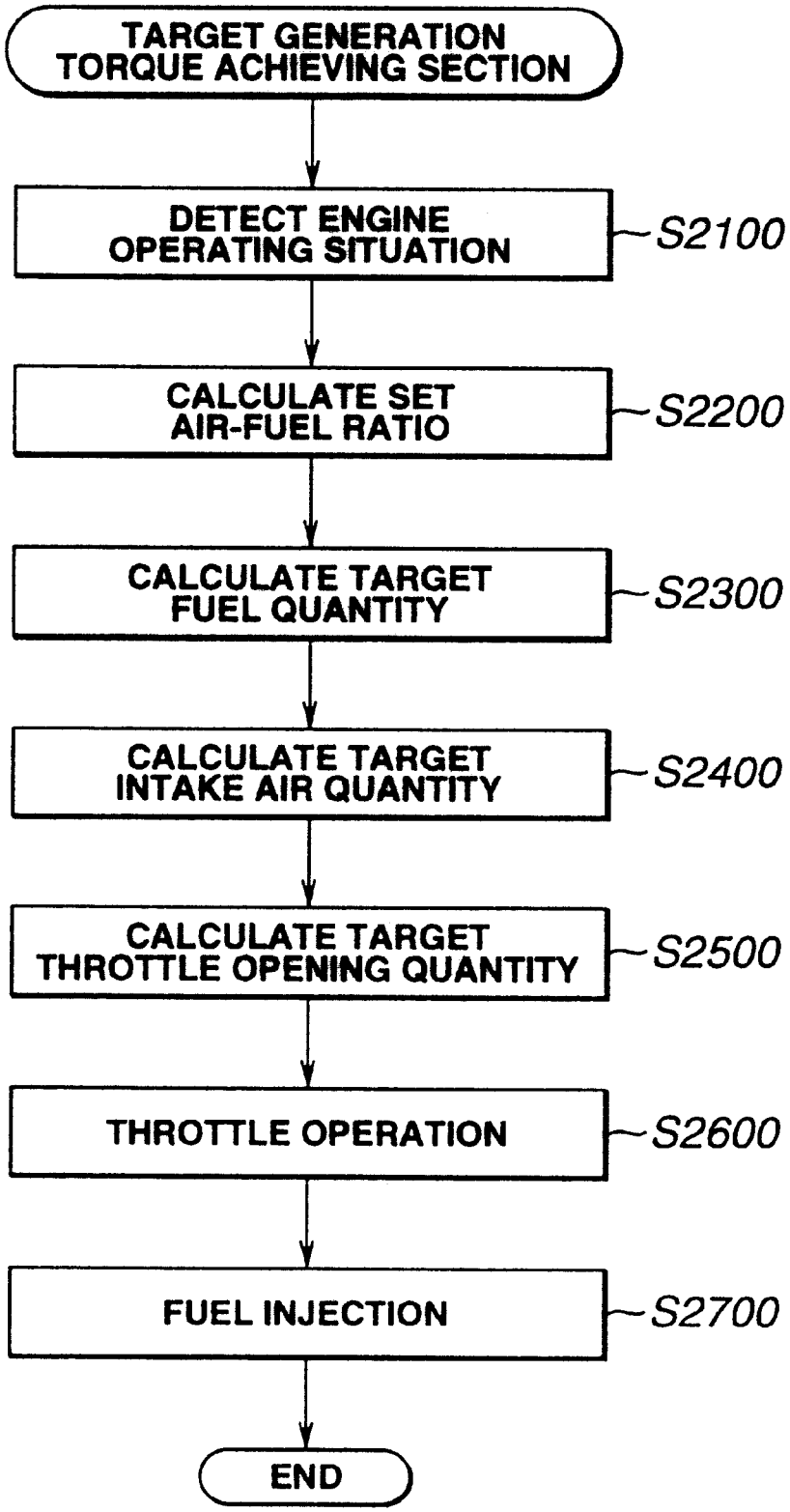
FIG. 20 is a flowchart for a target generation torque achieving section according to the fifth embodiment.

The procedure for achieving this target generation torque is explained with reference to the flowchart of FIG. 20.

First, at a step 2100, the engine operating situation is detected. This includes determining the above-mentioned target generation torque, the actual engine speed, and the warm-up condition of the engine. At a step 2200, reference is made to an air-fuel ratio map having predetermined characteristics such as the one shown as an example in FIG. 12 (corresponding to operation after warm-up) and a set air-fuel ratio corresponding to the engine operating situation is calculated. At a step 2300, a target injection quantity is calculated in accordance with the target generation torque. As discussed, generation torque and fuel injection quantity are in an approximately proportional relationship. According to this relationship, the target injection quantity is calculated in accordance with the target generation torque. At a step 2400, from this target fuel injection quantity, the set air-fuel ratio, and the actual engine speed, the target intake air quantity is calculated. As discussed, this intake air quantity is obtained basically by multiplication of the above-mentioned three parameters and a coefficient. At a step 2500, a target throttle opening degree is calculated from this target intake air quantity, the engine speed, and the like. For example, this calculation can be based on the characteristic shown in FIG. 13. In this example, the target throttle opening degree is set in accordance with steady state characteristics. However, the target throttle opening degree can be set based on dynamics such as intake air transportation lag in the intake system. At a step 2600, the throttle valve (using, for example, actuator 30 and throttle valve 4 of FIG. 4) is controlled so that the target throttle opening degree is obtained Then, at a step 2700, fuel of the above-described target injection quantity is injected at a predetermined timing.

It is optional to incorporate, into the above-mentioned procedure, corrections to further refine the accuracy, such as a correction based on a difference in efficiency related to the set air-fuel ratio, and a phase correction related to a transportation lag in the intake system.

The feedback techniques described above in connection with FIG. 8. can also be applied to the calculation of the second target torque in this embodiment.

Although the invention has been described above by reference to certain embodiments of the invention, the invention is not limited to the embodiments described above. Modifications and variations of the embodiments described above will occur to those skilled in the art, in light of the above teachings. For example, the characteristic curves shown in the Figures are merely examples and other curves can be employed. The scope of the invention is defined with reference to the following claims.

What is claimed is:

1. An engine speed controller for a vehicle having an engine, comprising:

a target generation torque calculating section to calculate a target generation torque; and a control target quantity calculating section to calculate a control target quantity based on at least an engine speed parameter and the target generation torque, the engine speed parameter representing an actual engine speed during non-idling control operation, and the engine speed parameter representing a target idle speed during idling control operation.

2. A controller as set forth in claim 1, wherein the control target quantity calculating section calculates, as the control target quantity, intake air to the engine based on a product of the engine speed parameter, air-fuel ratio, required fuel quantity, and a coefficient.

3. A controller as set forth in claim 1, wherein, during idling control operation the target generation torque calculating section calculates the target torque based on the target idle speed.

4. A controller as set forth in claim 1, wherein the control target quantity calculating section employs transient target idle speeds to smooth transitions between idling control operation and non-idling control operation.

5. A controller as set forth in claim 2, wherein the air-fuel ratio is calculated based on the target idle speed.

6. A controller as set forth in claim 1, wherein the target generation torque calculating section includes:

a first target torque calculating section to calculate a first target torque that corresponds to a driver's request;

a second target torque calculating section to calculate a second target torque corresponding to engine loads due to at least one of (1) engine friction and (2) accessory units;

a third target torque calculating section to calculate a third target torque, the third target torque being based on a difference between actual engine speed and the target idle speed and being set so as to maintain the target idle speed during idling control operation, the third target torque being set equal to a predetermined value during non-idling control operation; and another target torque calculating section to calculate the target generation torque based on the first, second, and third target torques.

7. A controller as set forth in claim 6, wherein, during idling control operation, the control target quantity calculating section calculates intake air based on the target idle speed and sets the calculated intake air as the control target quantity.

8. A controller as set forth in claim 6, wherein the control target quantity calculating section generates and employs transient target engine speeds during transitions between idling control operation and non-idling control operation.

9. A controller as set forth in claim 1, wherein said target generation torque calculating section includes:

a first target torque calculating section to calculate a first target torque that corresponds to a driver's request;

an engine load calculating section to calculate engine loads due to at least one of (1) engine friction and (2) accessory units;

a second target torque calculating section to calculate a second target torque corresponding to said engine loads; and another target torque calculating section to calculate the target generation torque from said first and second target torques;

wherein said engine load calculating section employs the target idle speed in calculating said engine loads during idling control operation.

10. A controller as set forth in claim 1, wherein the target generation torque calculating section includes:

a first target torque calculating section to calculate a first target torque that corresponds to a driver's request;

an engine load calculating section to calculate engine loads due to at least one of (1) engine friction and (2) accessory units;

a second target torque calculating section to calculate a second target torque corresponding to said engine loads; and another target torque calculating section to calculate the target generation torque from said first and second target torques;

wherein said engine load calculating section employs the target idle speed in calculating said engine loads during idling control operation when actual engine speed is lower than the target idle speed during idling control operation.

11. A controller as set forth in claim 9, wherein transient target engine speeds are employed to smooth transitions between idling control operation and non-idling control operation.

12. A controller as set forth in claim 10, wherein transient target engine speeds are employed to smooth transitions between idling control operation and non-idling control operation.

* * * * *